US005454741A

United States Patent [19]

Okada

[11] Patent Number: 5,454,741

[45] Date of Patent: Oct. 3, 1995

[54] BATTERY TERMINAL

[75] Inventor: Hajime Okada, Yokkaichi, Japan

[73] Assignee: Sumitomo Wiring Systems, Ltd., Yokkaichi, Japan

[21] Appl. No.: 175,501

[22] Filed: Dec. 30, 1993

[30] Foreign Application Priority Data

Jan. 7, 1993 [JP] Japan ..... 5-000152 U

[51] Int. Cl.[6] ..... H01R 13/00

[52] U.S. Cl. ..... 439/762

[58] Field of Search ..... 439/762–765, 439/770, 772, 774, 754; 429/178

[56] References Cited

U.S. PATENT DOCUMENTS

| | | | |
|---|---|---|---|
| 1,645,033 | 10/1927 | Witkowski | 439/762 |
| 1,746,514 | 2/1930 | Baunach | 439/762 |
| 3,116,100 | 12/1963 | Hunter | 439/757 |
| 4,367,008 | 1/1983 | Piriz | 439/762 |
| 5,088,941 | 2/1992 | Nolle | 439/762 |
| 5,290,646 | 3/1994 | Asao et al. | 429/178 |
| 5,302,142 | 4/1994 | Tabata et al. | 439/762 |
| 5,302,143 | 4/1994 | Inoue et al. | 439/762 |

FOREIGN PATENT DOCUMENTS

| | | |
|---|---|---|
| 0451488 | 10/1991 | European Pat. Off. . |
| 4-9736 | 3/1992 | Japan . |

OTHER PUBLICATIONS

Translation of the Abstract of EPO–0 451 488.
European Search Report and Annex.

*Primary Examiner*—William Briggs
*Attorney, Agent, or Firm*—Sandler, Greenblum & Bernstein

[57] ABSTRACT

A battery terminal mounted on a battery post has a cylindrically shaped post fitting, clamping members, a cable connector, and a tightening tool. The cable connector is formed by bending a vertically oriented metal band. Post fitting and clamping members are formed from a vertically oriented metal band, such that the clamping members are connected to the free ends of the post fitting. The clamping members 18A, 18B are further bent to provide sliding surfaces matching the tapers of the tightening tool. By tightening a bolt down from above, the clamping members are moved horizontally together, and the free ends of the post fitting are thus closed to clamp the battery post.

12 Claims, 2 Drawing Sheets

BATTERY TERMINAL

BACKGROUND OF THE INVENTION

1. Field of the Invention

The present invention relates to a battery terminal mounted to the post of a motor vehicle battery, and particularly to a battery terminal that is clamped using a tightening tool by tightening a bolt from above to firmly clamp the battery terminal to the battery post.

2. Description of the Prior Art

As shown in FIG. 4, the main terminal 3 of a conventional battery terminal of this type is made by bending a flat metal plate in two around a curve 3*a* at one end of the resulting main terminal 3. The top and bottom parts of this main terminal 3 are roughly identical in shape, and the bend imparts a certain flexibility to the terminal.

This main terminal 3 comprises a pair of top and bottom circular post fittings 3*b*, each of which is flat in the horizontal direction and both of which are fit over the battery post 2. A pair of right and left tightening members 3*c*, which are similarly flat in the horizontal direction, are provided contiguous to the free open ends of the circular post fittings 3*b*. The cable connector 3*d* is provided at the other, closed, end of the circular post fittings 3*b*.

A bearing washer 5 is placed at the outside of one of the tightening members 3*c*, and a bolt 6 is passed through the bearing washer 5 from the outside of the other tightening member 3*c*. A nut 7 is then threaded onto the bearing washer 5 end of the bolt 6 and tightened against the bearing washer 5 to tighten the right and left tightening members 3*c*, thus closing the free end of the circular post fittings 3*b* and firmly clamping the battery terminal to the battery post 2.

Because this main terminal is manufactured by bending a single metal plate and the components are fairly complex bent shapes, a thick metal plate cannot be used. The mechanical strength of the terminal cannot, therefore, be set high, the torque applied to the bolt 6 to tighten the tightening members 3*c* is not consistent, and poor contact between the battery terminal and battery post 2 can result from the instability of the bolt clamping force.

In addition, the engine rooms of recent vehicles are crowded with a growing number of components installed in a confined space. This makes it difficult to adequately tighten the terminal fitting by applying a horizontal force because of interference by other engine room components with the tools. It is even possible for the impact wrench to contact the negative terminal while tightening the positive terminal fitting, causing an electrical short which, in a worst-case scenario, could cause an engine room fire.

SUMMARY OF THE INVENTION

The object of the present invention is therefore to increase the thickness of the metal plate, and thereby increase the mechanical strength, by simplifying the shape of the main terminal formed from metal plate. The required tightening torque can thus be made more consistent, the bolt can be tightened from above and the vertical tightening force can be converted to a horizontal force to firmly clamp the post fittings to the battery post and assure positive terminal-post contact.

To achieve this object a battery terminal according to the present invention comprises a cable connector adapted for connection with an electrical cable; an annular post fitting formed by bending a vertically oriented metal band in an arc to form a vertically oriented cylindrical shape, and having open free ends; first and second clamping members contiguous to said open free ends of the post fitting, and formed by end portions of said vertically oriented metal band, said first and second clamping members having tapered sliding surfaces; a tightening tool comprising tapered surfaces fit over said tapered sliding surfaces; a nut positioned inside the clamping members; and a bolt passed through the tightening tool and tightened into the nut to move the tightening tool towards said first and second clamping members, thereby closing the first and second clamping members, and in turn, closing the free ends of the post fitting to firm clamp the battery terminal to the battery post.

Claws projecting to the inside to hold the nut, and jam walls preventing nut rotation are also provided in the right and left clamping members of the main terminal.

Plural vertical grooves are provided in the inside wall of the main terminal post fitting to enable the free ends of the post fitting to move smoothly in the opening and closing directions.

In addition, the main terminal is formed from thicker metal plate than that used in the conventional main terminal shown in FIG. 4. For example, while the typical plate thickness in a conventional terminal is 1.2 mm, 2.0 mm thick plate is used in the present invention.

The thickness of the plate used to manufacture the main terminal can be increased in a battery terminal according to the present invention because the annular post fitting of the main terminal and the right and left clamping members contiguous to the free ends thereof are formed from a single vertically oriented plate and are shaped more simply than those of the prior art. The tightening torque of the bolt can also be stably applied because the mechanical strength of the main terminal can thus be increased.

In addition, because the right and left clamping members are shaped to provide sliding surfaces following the tapered surfaces of the tightening tool, the downward travel of the tightening tool caused by tightening the bolt is converted to movement closing the free ends of the post fitting contiguous to the clamping members, and the battery terminal can be positively clamped to the battery post. In other words, the battery terminal can be tightened from a position above the battery terminal, and the problems caused by tightening from the side do not occur as with the prior art.

BRIEF DESCRIPTION OF THE DRAWINGS

The present invention will become more fully understood from the detailed description given below and the accompanying diagrams wherein.

DESCRIPTION OF PREFERRED EMBODIMENTS

Figure 1:
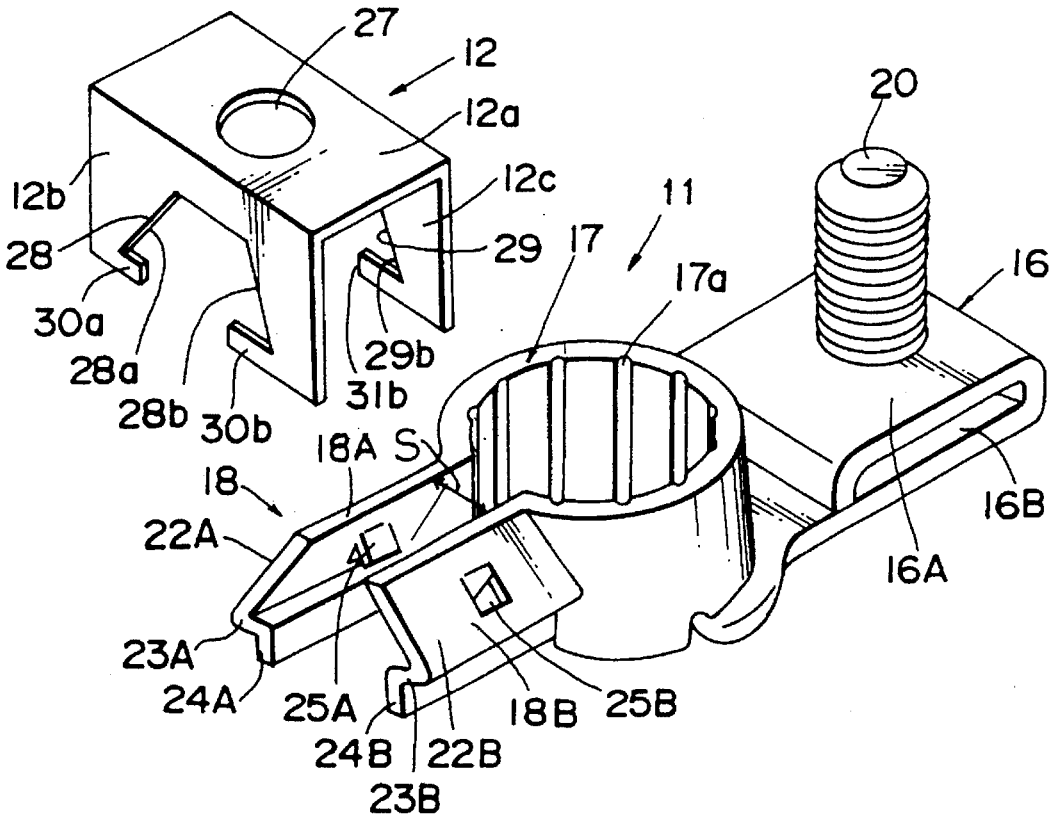
FIG. 1 is a perspective view of the disassembled parts of a battery terminal according to the present invention.

Referring to FIG. 1, a battery terminal 10 of the present invention comprises a main terminal 11, tightening tool 12, bolt 13, and nut 14.

The main terminal 11 is a stud-type terminal formed by bending a single metal plate as shown in the figure, forming a cable connector 16, post fitting 17, and clamping members 18.

The cable connector 16 is formed by bending a rectangular plate in two horizontally to form top and bottom members 16A and 16B, respectively, and bending the end of the top member 16A down against the bottom member 16B. The terminal to which the electrical cable is crimped (not shown in the figures) is secured by a nut (not shown in the figures) to a stud bolt 20 projecting from approximately the center of the top member 16A.

The post fitting 17 is contiguous to the bottom member 16B of the cable connector 16, and is formed by bending a vertical metal strip perpendicular to the cable connector 16 into a ring shape to form a vertically oriented cylindrical shape. Plural vertical grooves 17*a* are formed at an even interval in the inside circumference wall of the post fitting 17. The side of the post fitting 17 opposite the cable connector 16 is open, forming two free ends.

The clamping members 18 are a pair of right and left clamping members 18A and 18B contiguous to the free ends of the post fitting 17 with a gap S between the clamping members 18A and 18B.

Because the right and left clamping members 18A and 18B are connected to the free ends of the vertically oriented post fitting 17, they are formed from similarly vertically oriented metal bands. The right and left clamping members 18A and 18B have sliding surfaces 22A and 22B, respectively, sloping down to the outside from the top thereof. The bottom end of each sliding surface 22A or 22B is bent horizontally back to the inside forming flats 23A or 23B. The inside end of each flat 23A or 23B bends vertically down to form a jam wall 24A or 24B for preventing the rotation of nut 14.

Claws 25A and 25B projecting into the clamping members 18 are also formed by punching the clamping members 18 in at approximately the center of the sliding surfaces 22A and 22B.

The tightening tool 12 is an essentially inverted U-shaped member with a top 12*a* and two sides 12*b* and 12*c*, and a bolt hole 27 in the center of the top 12*a*. Cut-outs 28 and 29 open to the bottom are also provided at the center of the two sides 12*b* and 12*c* projecting down from the edges of the top 12*a*.

A taper 28*a* and 28*b* in side 12*b* and a taper 29*a* and 29*b* (28*a* not shown in the figures) in side 12*c* are formed such that they are wider at the bottom than the top and match the slope of the right and left clamping members 18A and 18B of the main terminal 11. Claws 30*a*, 30*b*, 31*a* and 31*b* (31*a* not shown in the figures) projecting to the inside of the cut-outs 28 and 29 are formed at the bottom ends of the tapers 28*a*, 28*b*, 29*a* and 29*b*.

Figure 2:
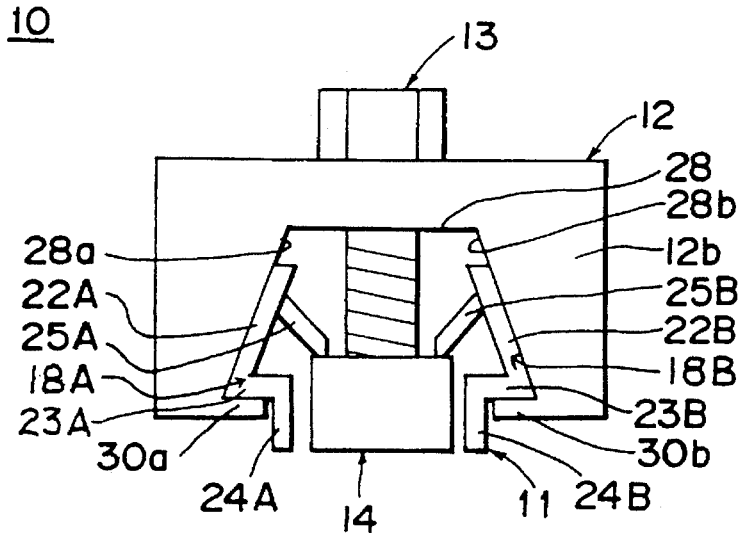
FIG. 2 is a front view showing the semi-locked position of the battery terminal.
Figure 4:
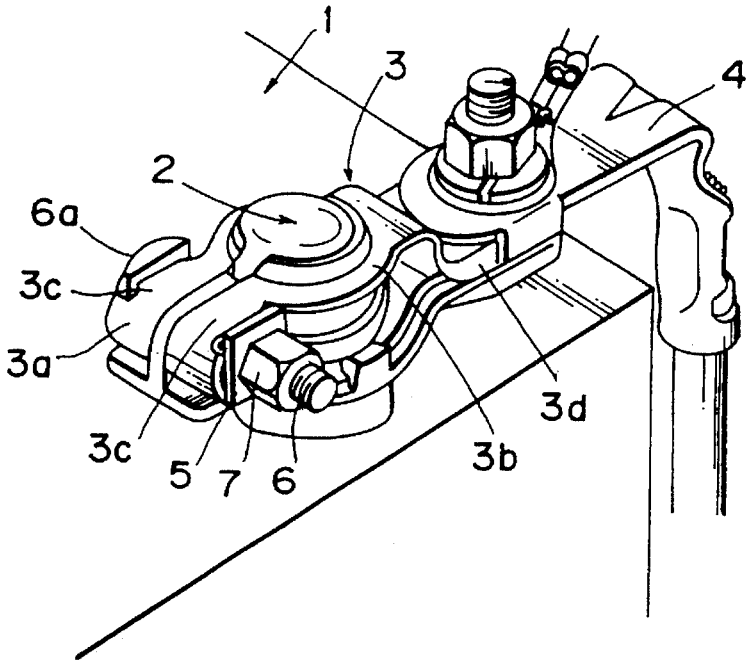
Fig. 4 PRIOR ART
FIG. 4 is a perspective view of a conventional battery terminal.

As shown in FIG. 2, the tightening tool 12 is fit over the clamping members 18A and 18B of the main terminal 11 before the battery terminal 10 is mounted to the battery post 2 (shown in FIG. 4). The square nut 14 is then placed between the clamping members 18A and 18B, the bolt 13 is passed through the bolt hole 27 of the tightening tool 12, and is partially threaded into the nut 14 to present a semi-locked state of the battery terminal 10.

In this position, the tapers 28*a*–29*b* of tightening tool 12 can slide against the sliding surfaces 22A and 22B of the main terminal 11, and the bottom ends of the sliding surfaces 22A and 22B contact the claws 30*a*–31*b* of the tightening tool 12.

The top of the nut 14 is also against the bottom end of the claws 25A and 25B projecting to the inside of the clamping members 18A and 18B. The sides of the nut 14 are also held by the jam walls 24A and 24B of the main terminal 11 so that the nut 14 will not turn when the bolt 13 is tightened.

The operation for mounting the battery terminal 10 to the battery post 2 in this semi-locked state is described below.

The battery terminal 10 is first assembled in the semi-locked state as described above, and is fit down onto the battery post 2. Note that the main terminal 11 can be fit easily to the battery post 2 because the free ends of the main terminal 11 post fitting 17 are open.

An impact wrench or similar tool is then fit to the bolt 13 head, and the bolt 13 is tightened.

As the bolt 13 is tightened, the bolt 13 and tightening tool 12 both descend. This downward movement of the tightening tool 12 is converted by the movement of the tapers 28*a*–29*b* sliding against the sliding surfaces 22A and 22B of the main terminal 11 into a horizontal movement of the clamping members 18.

As the sliding surfaces 22A and 22B move horizontally together, the free ends of the connected post fitting 17 also close, thus clamping the battery post 2 inside the post fitting 17. The tightening force applied vertically to the bolt 13 is thus converted through the tightening tool 12 tapers 28*a*–29*b* to a horizontal force moving the right and left clamping members 18A, 18B horizontally together and tightening the free ends of the connected post fitting 17.

Figure 3:
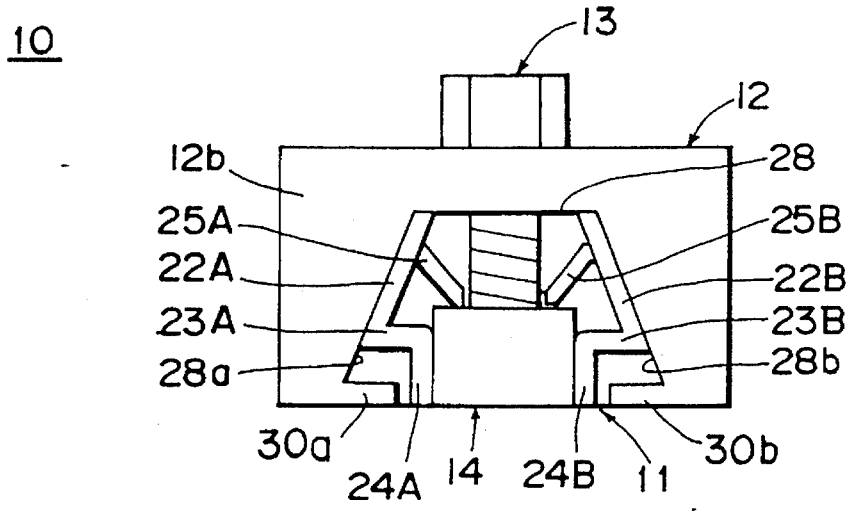
FIG. 3 is a front view showing the battery terminal when clamped.

As shown in FIG. 3, the post fitting 17 is thus clamped against the outside circumference of the battery post 2, and the battery terminal 10 is clamped in positive contact to the battery post 2.

The thickness of the main terminal 11 can thus be increased in a battery terminal 10 according to the present invention because the post fitting 17 and clamping members 18A, 18B of the main terminal are formed from a single vertically oriented metal band and are extremely simple in shape. The plate thickness in this embodiment is approximately 2.0 mm, approximately 0.8 mm thicker than in a conventional battery terminal. This also makes it possible to increase the mechanical strength of the battery terminal 10.

The battery terminal can also be firmly clamped by tightening a bolt from above because the vertical movement of the tightening tool 12 created by tightening the bolt 13 is converted by means of the tightening tool 12 tapers 28*a*–29*b* and the main terminal 11 sliding surfaces 22A and 22B to the horizontal movement of the free ends of the post fitting 17.

It is also possible to positively clamp the battery post 2 even though the plate thickness is increased because vertical grooves 17*a* are provided in the inside wall of the main terminal 11 post fitting 17 contiguous to the sliding surfaces 22A and 22B.

As will be obvious from the above description, because the post fitting and right and left clamping members are formed from a single vertically oriented metal band in a battery terminal according to the present invention, the shape of the main terminal can be simplified, and the thickness of the metal plate forming the main terminal can be increased as a result. It is thereby possible to increase the mechanical strength of the main terminal, and to prevent deformation of the clamping members when the bolt is tightened.

In addition, because the clamping members are bent and sliding surfaces corresponding to the shape of the tightening tool tapers are provided, the downward movement of the tightening tool caused by bolt tightening can be converted by the tightening tool tapers to an inward horizontal movement of the post fitting free ends contiguous to the clamping members. The bolt can thus be tightened from above, and the problems associated with tightening the clamping bolt from the side can be eliminated.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A battery terminal mounted on a battery post, comprising:

a cable connector adapted for connection with an electrical cable;

an annular post fitting formed by bending a vertically oriented metal band in an arc to form a vertically oriented cylindrical shape, and having open free ends;

first and second clamping members contiguous to said open free ends of the post fitting, and formed by end portions of said vertically oriented metal band, said first and second clamping members having tapered sliding surfaces;

a tightening tool comprising tapered surfaces fitting over said tapered sliding surfaces;

a nut positioned inside the clamping members;

said first and second clamping members having jam walls, respectively, for preventing nut rotation; and a bolt passed through the tightening tool and tightened into the nut to move the tightening tool towards said first and second clamping members, thereby closing the first and second clamping members, and in turn, closing the free ends of the post fitting to firmly clamp the battery terminal to the battery post.

2. A battery terminal mounted on a battery post, comprising:

a cable connector adapted for connection with an electrical cable;

an annular post fitting formed by bending a vertically oriented metal band in an arc to form a vertically oriented cylindrical shape, and having open free ends;

first and second clamping members contiguous to said open free ends of the post fitting, and formed by end portions of said vertically oriented metal band, said first and second clamping members having tapered sliding surfaces;

a tightening tool comprising tapered surfaces fitting over said tapered sliding surfaces;

a nut positioned inside the clamping members;

said first and second clamping members having claws, respectively, for being engaged with said nut; and a bolt passed through the tightening tool and tightened into the nut to move the tightening tool towards said first and second clamping members, thereby closing the first and second clamping members, and in turn, closing the free ends of the post fitting to firmly clamp the battery terminal to the battery post.

3. A battery terminal according to claim 2, wherein said first and second clamping members have jam walls, respectively, for preventing nut rotation.

4. A battery terminal according to claim 2, wherein said tightening tool has claws for engagement with said first and second clamping members.

5. A battery terminal according to claim 2, wherein said metal band has a thickness of 2.0 mm.

6. A battery terminal according to claim 1, wherein said first and second clamping members have claws, respectively, for being engaged with said nut.

7. A battery terminal according to claim 1, wherein said tightening tool has claws for engagement with said first and second clamping members.

8. A battery terminal according to claim 1, wherein said metal band has a thickness of 2.0 mm.

9. A battery terminal mounted on a battery post, comprising:

a cable connector adapted for connection with an electrical cable;

an annular post fitting formed by bending a vertically oriented metal band in an arc to form a vertically oriented cylindrical shape, and having open free ends;

first and second clamping members contiguous to said open free ends of the post fitting, and formed by end portions of said vertically oriented metal band, said first and second clamping members having tapered sliding surfaces;

a tightening tool comprising tapered surfaces fitting over said tapered sliding surfaces;

said tightening tool having claws for engagement with said first and second clamping members;

a nut positioned inside the clamping members; and a bolt passed through the tightening tool and tightened into the nut to move the tightening tool towards said first and second clamping members, thereby closing the first and second clamping members, and in turn, closing the free ends of the post fitting to firmly clamp the battery terminal to the battery post.

10. A battery terminal according to claim 9, wherein said first and second clamping members have claws, respectively, for being engaged with said nut.

11. A battery terminal according to claim 9, wherein said first and second clamping members have jam walls, respectively, for preventing nut rotation.

12. A battery terminal according to claim 9, wherein said metal band has a thickness of 2.0 mm.

* * * * *